US005298031A

United States Patent [19]

Gabay et al.

[11] Patent Number: 5,298,031

[45] Date of Patent: Mar. 29, 1994

[54] METHOD FOR TREATING VELVET-LIKE FABRIC WHICH IS SIMULTANEOUSLY EMBOSSED AND DECORATED

[75] Inventors: Amnon Gabay, Newtonville; Amiram Inbal, Brookline; Moshe Rock, Andover; Lloyd Pease, Westford, all of Mass.; Robert Ryan, Tuftenboro, N.H.; Yechiel Naor, Brookline, Mass.

[73] Assignee: Malden Mills Industries Inc., Lawrence, Mass.

[21] Appl. No.: 971,703

[22] Filed: Nov. 4, 1992

Related U.S. Application Data

[63] Continuation of Ser. No. 679,676, Apr. 4, 1991, abandoned.

[51] Int. Cl.[5] ..... D06M 5/00

[52] U.S. Cl. ..... 8/471; 8/478; 8/488; 8/486; 8/500

[58] Field of Search ..... 8/471, 478, 488, 486, 8/500

[56] References Cited

U.S. PATENT DOCUMENTS

| | | | |
|---|---|---|---|
| 1,540,287 | 6/1925 | Roehlen | 101/157 |
| 1,542,796 | 6/1925 | Mairesse | 101/32 |
| 1,744,829 | 1/1930 | Dreyfus | 8/470 |
| 1,895,243 | 1/1933 | Dort | 8/470 |
| 3,850,095 | 11/1974 | Snyder | 101/32 |
| 4,086,112 | 4/1978 | Porter | 156/73.1 |
| 4,238,190 | 12/1980 | Rejto | 8/471 |
| 4,255,150 | 3/1981 | Fennekels et al. | 8/471 |
| 4,314,813 | 2/1982 | Masaki | 8/468 |

OTHER PUBLICATIONS

Fairchild's Dictionary of Textiles, (Fairchild Publications), 1975, pp. 23, 23b, 43b, 622.

*Primary Examiner*—Paul Lieberman
*Assistant Examiner*—Michael P. Tierney
*Attorney, Agent, or Firm*—Blum Kaplan

[57] ABSTRACT

The present invention relates to an improved method for embossing and decorating a thermoplastic velvet-like fabric. A transfer sheet supporting a thermally-activated decoration is simultaneously passed with a fabric between two rolls which are under pressure with respect to each other. At least one of the rolls is engraved so as to cause embossing of the fabric. The passing of the fabric and transfer sheet between the rolls is carried out at a temperature sufficient to activate the decoration and allow the transfer of the decoration to the embossed portions of the fabric. The fabric may be heated prior to the embossing-decorating step so that the velvet-like pile is at least partially plasticized. The fabric is then brushed to erect the pile to an erect position. If the decorating is printing, the fabric may be heated immediately before and after the embossing/-printing step to transfer a sufficient amount of dye, and to penetrate and seal the dye within the fabric.

52 Claims, 1 Drawing Sheet

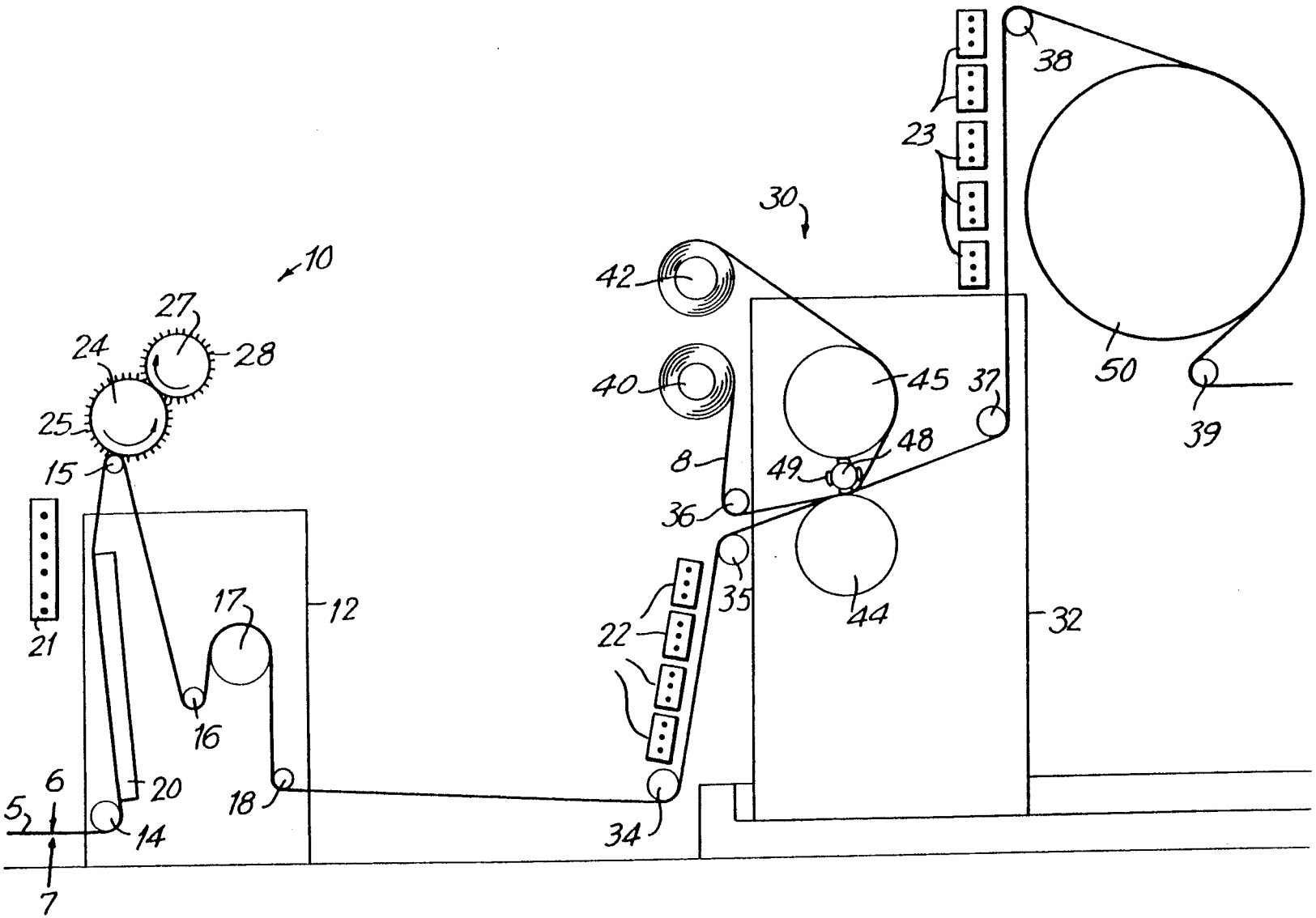
10
12
14
15
16
17
18
20
21
22
23
24
25
27
28
30
32
34
35
36
37
38
39
40
42
44
45
48
49
50
5
6
7
8

METHOD FOR TREATING VELVET-LIKE FABRIC WHICH IS SIMULTANEOUSLY EMBOSSED AND DECORATED

This is a continuation of application Ser. No. 07/679,676 filed Apr. 4, 1991, now abandoned.

BACKGROUND OF THE INVENTION

This invention is directed to a method and apparatus for treating a fabric which is simultaneously embossed and decorated and, in particular, to a method and apparatus for treating a velvet-like fabric.

The process of embossing fabrics is known in the art. Embossed fabrics have raised or projected figures or designs in relief on fabric surfaces. Embossed surfaces are usually produced by passing the fabric through engraved, heated rolls under heavy pressure to give a raised effect. The fabric may be passed through two rolls, one of which is engraved and the other being smooth, or both rolls may be engraved in such a manner that when the rolls are synchronized, the indentations in one roll at the point of embossing cooperate with protuberances on the other roll.

The method of heat transfer printing is also well known in the art. This is a method of printing fabric made of polyester or other thermoplastic fibers with disperse dyes. The design is transferred from preprinted paper onto the fabric by contact heat. Having no affinity for paper, the dyes are absorbed by the fabric. To complete the transfer, the preprinted paper must be in contact with the fabric for a sufficiently long residence time, i.e. the time during which the fabric is between the rolls, although the length of residence time may be reduced if the pressure on the preprinted paper and fabric is increased. The method is capable of producing well defined, clear prints.

Processes for simultaneously embossing and transfer printing to fabrics are known in the art as well. In U.S. Pat. No. 1,744,829 and U.S. Pat. No. 1,895,243, the simultaneous printing and embossing of cellulosic fabrics is disclosed. A transfer dye sheet and cellulosic fabric are simultaneously passed between one embossed and one smooth roll under high pressure with the transfer sheet passed through directly next to the engraved roll. No printing or embossing occurs at the portions of the fabric which pass between the smooth roll and the engraved portions of the engraved roll because the engraving is of a sufficient depth that the fabric does not contact the embossing roll at the engraved portions. Either the transfer printing sheet or the fabric is moistened prior to passing between the rolls. Both patents teach that heating the rolls increase the transferability of the dye in the transfer sheet to the fabric. The simultaneous transferring and embossing operation allows the printing to be transferred directly to the portion of the fabric which has been embossed, i.e., the portion of the fabric pressurized by the protuberances on the engraved roll.

The disadvantages of the apparatuses and methods taught by these patents is that they produce less than satisfactory results if the fabric to be embossed and decorated possesses depth, as in velvet-like fabrics, instead of ordinary flat woven and knit fabrics. Velvet-like fabrics and methods of producing them are known in the art. Velvet-like fabrics include a base and a surface region defined by a short, but usually dense, pile formed of fibers. Velvet-like fabrics may be knit, woven or flocked. For example, a woven velvet-like fabric may be made by producing a double-cloth structure woven face to face, with the pile ends interchanging between the two cloths. The two fabrics are cut apart by a traversing knife, producing two fabrics with a cut-pile surface. In another method, pile ends are lifted over cutting wires which are inserted in the same manner as the filling and the pile is cut as the wire is withdrawn.

Flock fabrics are another type of velvet-like fabrics which are produced by a process known as "flocking" in which adhesive is printed or coated on a fabric, and finely cut fibers are either adhered to or embedded in the fabric by means of dusting, air-blasting or electrostatic attraction. The finely cut fibers remain adhered to or embedded in the fabric at those portions of the fabric which were printed and coated with adhesive. The result is a velvet-like fabric. In a variation known as flock printing, only selected portions of the fabric are printed or coated with adhesive and, after the finely cut fibers are adhered to or embedded in the fabric, the fibers not secured by adhesive are removed by mechanical action.

In simultaneously embossing and decorating a pile fabric such as a velvet-like fabric, the fiber ends not attached to the fabric base, or embedded in the adhesive if the fabric is a flock fabric, may not be erect and so the fibers may be laying down prior to the embossing step, particularly if the fabric has been rolled-up. The contrast between the embossed and non-embossed portions will thus be reduced if the non-embossed portions are flat. Thus, a velvet-like fabric which is simply processed with the embossing and decorating methods taught in the prior art will have a less than satisfactory contrast in color and contour between the embossed and non-embossed area.

Additionally, known methods for simultaneously embossing and decorating are less than completely satisfactory if the fabric is a thermoplastic fabric and the decorating step is transfer printing of dye. Thermoplastic fabrics are fabrics at least the surface region of which are essentially made from synthetic materials such as nylon, polyester and acrylic which soften or "plasticize" when heated. Such surface regions are capable of embossing by the application of heat and pressure. One problem with known methods is due to the limited residence time of the fabric between the rolls during the step of embossing and printing. Not enough dye may be transferred to the fabric since the residence time may be insufficient to heat the fabric and pre-printed paper to the required temperature and transfer enough dye to the fabric. Yet another problem is that thermoplastic fabrics do not "soak up" dyes readily in the transfer printing process when the time to transfer the dye is brief, and much of the dye will rub off the fabric after the simultaneous step of embossing and printing.

Accordingly, a method and apparatus for simultaneously embossing and decorating a thermoplastic velvet-like fabric which overcomes the problems outlined above is desired.

SUMMARY OF THE INVENTION

Generally speaking, in accordance with the instant invention, a method for embossing and decorating a velvet-like fabric is provided. The velvet-like fabric includes a base and a pile of thermoplastic fibers, and the base may or may not be the same material as the pile. The fabric is heated so that the pile fibers are at least partially plasticized, and then brushed to erect the pile fibers to an erect position. A transfer sheet supporting a thermally-activated decoration is simultaneously passed with the fabric between two rolls which are under pressure with respect to each other. At least one of the rolls is engraved so as to cause embossing of the fabric. The passing of the fabric and transfer sheet between the rolls is carried out at a temperature sufficient to activate the decoration and allow the transfer of the decoration to the embossed portions of the fabric.

Also provided is a method for embossing and printing a velvet-like fabric. The velvet-like fabric includes a base and a pile of thermoplastic fibers, and the base may or may not be the same material as the pile fibers. The fabric is heated immediately before being passed between the two rolls so that the temperature of the fabric is nearer the required temperature and so that the resulting dye transfer is improved. Additionally, the fabric is heated after passing through the rolls to penetrate the dye into the fabric.

An apparatus for embossing and decorating velvet-like fabrics is also provided. A heater partially plasticizes the pile fibers and a brush erects the pile fibers on the fabric. An engraved roll cooperates with an opposing roll at a pressure sufficient to emboss the fabric as it passes therethrough. Means are provided to convey the fabric from the heater, to the brush and through the rolls. A transfer sheet supporting a thermally-activated decoration is also conveyed through the rolls simultaneously with the velvet-like fabric, with the transfer sheet positioned between the fabric and the engraved roll. Either the engraved roll, the opposing roll or both thermally activate the decoration to allow the transfer of the decoration to the embossed portions of the fabric.

The depth of engraving, which defines a pattern, is preferably chosen to leave essentially erect the pile fibers in registration therewith. In a preferred embodiment, the depth of engraving is essentially equal to or greater than the height of the pile fibers.

Finally, an apparatus for embossing and printing velvet-like fabrics is also provided. One or more heaters are used immediately before the simultaneous embossing and printing step so that the temperature of the fabric is nearer the temperature necessary which results in an improved transfer of the dye. Additionally, one or more heaters are used immediately after the simultaneous embossing and printing step to penetrate the dye into the fabric.

Accordingly, it is an object of the present invention to provide an improved method for embossing and decorating thermoplastic velvet-like fabric.

Another object of the invention is to provide an improved apparatus for decorating and embossing thermoplastic velvet-like fabric.

A further object of the invention is to provide a thermoplastic velvet-like fabric which has been simultaneously decorated and embossed.

Still another object of the invention is to provide a method for simultaneously embossing and heat transfer printing thermoplastic velvet-like fabric.

A further object of the invention is to provide a method for simultaneously embossing and transferring foil or other appliqués to velvet-like fabric.

Still another object of the invention is to provide a method and apparatus for simultaneously embossing and decorating velvet-like fabric having improved color and contour contrast between the embossed and non-embossed areas.

Yet another object of the invention is to provide a method and apparatus for simultaneously embossing and printing thermoplastic fabric where the dye is more permanently sealed in the fabric.

An additional object of the invention is to compensate for the disadvantages of short residence time of embossing and decorating a fabric through rolls.

Still other objects and advantages of the invention will in part be obvious and will in part be apparent from the specification.

The invention accordingly comprises the several steps and the relation of one or more of such steps with respect to each of the other, the apparatus embodying features of construction, combinations and arrangements of parts which are adapted to effect such steps, and the article which possesses the characteristics, properties and relation of elements, all as exemplified in the detailed disclosure hereinafter set forth, and the scope of the invention will be indicated in the claims.

BRIEF DESCRIPTION OF THE DRAWING

For a fuller understanding of the invention, reference is had to the following description taken in connection with the accompanying drawing, which is a schematic layout of the simultaneous embossing and decorating apparatus.

DETAILED DESCRIPTION OF THE PREFERRED EMBODIMENTS

Reference is made to the drawing which illustrates the schematic layout of the apparatus for decorating and embossing a thermoplastic velvet-like fabric according to the invention. The main apparatus for simultaneously embossing and decorating the fabric 5 is designated generally at 30, and the pre-treatment apparatus is designated generally at 10.

A velvet-like fabric includes a base and a surface region defined by a short, but usually dense, pile formed of fibers. For purposes of this invention, the pile is made of synthetic fibers which may be plasticized, i.e. softened, when heated. It is anticipated that some combination of natural fibers may be blended in the pile as well, as long as this does not interfere with the ability of the pile to be embossed and decorated.

One type of velvet-like fabric is flock fabric. However, it is anticipated that the invention is applicable to any type of velvet-like fabric which has a base and a surface region defining a pile formed essentially of a thermoplastic material and capable of being embossed by a heated embossing roll. A thermoplastic material is a material permanently fusible and having a tendency to soften at higher temperatures, fibers made of such materials being man-made. Fabric 5 is a flock fabric if it is produced by a process known as "flocking" in which adhesive is printed or coated on a fabric base, and finely cut fibers are applied all over by means of dusting, air-blasting or electrostatic attraction. Nonetheless, the invention is equally applicable to other forms of velvet-like fabrics including that which are woven or knit, in which the base and pile regions are usually continuous and formed of the same material.

In any velvet-like fabric to which the invention is applied, at least the surface region is made of a thermoplastic material. As used herein, thermoplastic fabrics are any velvet-like fabrics in which the surface region is made of a thermoplastic material such as nylon, polyester and acrylic which soften when heated. Although natural material may also be present in the surface region, the surface region is capable of being embossed by a heated embossing roll and preferably can be dyed by the process of transfer printing.

In a preferred embodiment, the fabric has a pile height of between about 0.8 and 2.3 mm, with a particularly preferred pile height of 1.2 mm. In addition, the denier of the fibers in the pile is preferably between about 0.8 and 3, with a particularly preferred denier of 1.1.

The surface of fabric 5 which shows the pile is designated the face 6 of fabric 5. The other side is the back 7 of fabric 5.

Fabric 5 is guided through both pre-treatment apparatus 10 and main apparatus 30 by a series of idler rolls 14–16, 18, 34, 35, 37 and 38 which will be discussed individually in further detail below. The idler rolls contain bearings which allow the idler rolls to rotate freely in response to pressure from fabric 5 but which do not actively pull fabric 5 through pre-treatment apparatus 10 and main apparatus 30. Instead, fabric 5 is actively pulled through apparatus 10 by driven roll 17 and through apparatus 30 by the pressure between first conveyor roll 44 and second conveyor roll 45 and drive from embossing roll 48, discussed in further detail below. In a preferred embodiment, fabric 5 is pulled by these rolls, and thus conveyed through pre-treatment apparatus 10 and main apparatus 30, at a speed of between about 1.5 and 4.5 meters/minute, with a particularly preferred speed of 3 meters/minute.

Fabric 5 is drawn into a pre-treatment frame 12 of pre-treatment apparatus 10 around first idler roll 14. Next, the back 7 of fabric 5 is drawn against a steam heater 20. Steam is continuously fed through steam heater 20. However, steam heater 20 is a closed structure so that fabric 5 does not become wet.

The front 6 of fabric 5 is meanwhile heated by radiation from electric heater 21. This combination of heating raises the temperature of fabric 5 so that the thermoplastic fibers in the pile begin to plasticize. If fabric 5 is a flock fabric, both the flock fibers and adhesive which adhere the flock fibers to fabric 5 begin to plasticize.

With the fibers thus softened, the face 6 of fabric 5 comes in contact with cylinder 24. Cylinder 24 is a rotating band with a series of nylon bristles 25 embedded therein. Nylon bristles 25 may be straight.

Cylinder 24 rotates at a surface speed greater than the speed at which fabric 5 is moving. Preferably, cylinder 24 rotates counterclockwise since the fibers in the pile are apt to be lying down with the ends not attached to fabric 5 further behind than where the other ends are attached. Nylon bristles 25 brush the face 6 of fabric 5 and cause the unattached ends of the softened fibers to stand erect.

The friction between cylinder 24 and cleaning brush 27 rotates cleaning brush 27. Cleaning brush 27 has cleaning bristles 28 which help clean off loose fibers which have collected on nylon bristles 25. Since cleaning brush 27 is in sympathy drive with cylinder 24, cleaning brush 27 rotates in the direction opposite to cylinder 24.

Fabric 5, conveyed by driven roll 17, is transported around idler rolls 16 and 18 and out of pre-treatment apparatus 10. At this point, the fibers which make up the pile on fabric 5 are in an erect position.

Since the fibers are pre-treated to stand erect before being embossed and decorated, the portions of fabric not embossed are at a maximum height and thus provide maximum contour contrast between the embossed and non-embossed areas of the fabric. The portions of the fabric not embossed remain erect, and so fibers not intended to be embossed are in fact not embossed.

Fabric 5 next enters main apparatus 30 by being conveyed around idler rolls 34 and 35 and into main frame 32. The face 6 of fabric 5 is heated by a plurality of infrared heaters 22. The advantage of infrared heaters 22 will be discussed further below.

At the same time, a transfer sheet 8 is drawn from transfer sheet let-off roll 40 and enters main apparatus 30 by being conveyed around idler roll 36.

Transfer sheet 8 supports a thermally-activated decoration. In the heat transfer printing embodiment, transfer sheet 8 is preprinted paper containing dyestuffs. Particularly preferred dyestuffs which may be used in the transfer paper include but are not limited to Disperse Blue 56 (e.g. Terasil Blue BGE Psf 100%, Ciba-Geigy Corp.), Disperse Red 60 (e.g. Terasil Brilliant Red FB, Ciba-Geigy Corp.), Disperse Violet 78 (e.g. Intrasperse Violet 2RB, Crompton & Knowles Corp , and Disperse Yellow 54 (e.g. Terasil Yellow 2 GW 200%, Ciba-Geigy Corp.). Transfer sheet 8 may also be a sheet of appliqué material, (decorated material) such as a foil, coated with a heat-activated adhesive.

Fabric 5 and transfer sheet 8 are passed between first conveyor roll 44 and embossing roll 48 with transfer sheet 8 located between embossing roll 48 and fabric 5. Embossing roll 48, in turn, is in contact with second conveyor roll 45. As previously noted, first and second conveyor rolls 44 and 45 are actively driven, as is embossing roll 48. The rotation of embossing roll 48 and first conveyor roll 44 and pressure maintained between first and second conveyor rolls 44 and 45 draws fabric 5 and transfer sheet 8 through embossing roll 48 and first conveyor roll 44.

First and second conveyor rolls 44 and 45 are spaced such that the pressure exerted on fabric 5 by embossing roll 48 and first conveyor roll 44 is sufficient to emboss fabric 5. This pressure is preferably between about 70 and about 110 kg/cm, with a particularly preferred pressure of about 100 kg/cm.

Embossing roll 48 is engraved so as to have protuberances 49 jutting therefrom defining a pattern. The actual embossing occurs at those portions of fabric 5 which are passed between protuberances 49 and first conveyor roll 44. The depth of the engraved portions of embossing roll 48 is preferably such as to leave the pile fibers essentially erect after embossing. The depth of the engraved portion is preferably essentially equal to or greater than the height of the pile when the fibers are in the erect, standing position to maximize the benefit of pre-treating fabric 5. The depth of the engraving of embossing roll 48 is preferably 2.6 mm.

Although a three-roll embossing system is shown in schematic diagram 1, it is anticipated that other roll configurations might be used, such as the two-roll embossing systems described in the prior art. Additionally, although first conveyor roll 44 is shaped as a smooth cylinder, first conveyor roll 44 might also be engraved to cooperate with embossing roll 48 such that when the rolls are synchronized, the protuberances on embossing roll 48 correspond to the engraved portions of first conveyor roll 44, and the protuberances of first conveyor roll 44 correspond to the engraved portions of embossing roll 48.

Embossing roll 48 contains hot oil running therethrough in the direction perpendicular to the movement of fabric 5. The hot oil is at a temperature sufficient to activate the thermally-activated decoration on transfer sheet 8. The decoration is thus transferred to the portion of fabric 5 being embossed during the embossing procedure. In the case of heat transfer printing, the dye is absorbed by the portion of fabric 5 being engraved since the dyes have no affinity for the paper on which they are printed. In the case of appliqué transfer, the adhesive on the appliqué material is thermally-activated and the appliqué is thus adhered to the portion of fabric 5 being engraved. The embossing pressure cuts the edges of the appliqué so that the portion of the appliqué attached to the engraved portion of fabric 5 is separated from the remaining appliqué transfer sheet. The embossing temperature is thus high enough to activate the thermally-activated decoration. This temperature will vary according to the conditions, but in the preferred embodiment the temperature is between about 200° and about 220° C., with a particularly preferred temperature of about 210° C.

Particularly in heat transfer printing, the amount of dye transferred from transfer sheet 8 to fabric 5 depends on the temperature of heated embossing roll 48, the pressure between first and second conveyor rolls 44 and 45, and the residence time of contact between fabric 5, transfer sheet 8 and heated embossing roll 48. Since the residence time is brief, the pre-heating of fabric 5 by infrared heaters 22 immediately before the dye-transfer step means that less of the residence time is spent raising the temperature of fabric 5. Therefore, more of the residence time is devoted to transferring the dye at the transfer temperature and more dye is transferred. Preferably, the pile fibers in fabric 5 are preheated to a temperature between about 180° and about 195° C., with a particularly preferred temperature of about 190° C. This temperature is the temperature at the surface or face of the pile fibers.

The remaining transfer sheet 8 exits main frame 32 and is wound onto transfer sheet re-roll 42.

The embossed and decorated fabric 5 is conveyed around idler roll 37, exits main frame 32, and is conveyed around idler roll 38. Particularly when the decoration transferred is a dye, the face 6 of fabric 5 is post-heated by infrared heaters 23 located between idler rolls 37 and 38. Preferably, fabric 5 is post-heated to a temperature between about 180° and about 195° C., with a particularly preferred temperature of 190° C. This temperature is the temperature at the surface or face of the pile fibers. Infrared heaters 23 allow the dye to further penetrate and set in fabric 5. For example, two fabrics were each simultaneously embossed and dyed in accordance with invention, except the first was not post-heated with infrared heaters while the second was. Both were subjected to the "crock" test in which a swatch of white fabric is rubbed onto the subject fabric and the amount of dye transferred to the white fabric is measured. The "crock" test scale is between 1 (worst) and 5 (best), with 1 having the most amount of dye transferred to the white fabric. Upon testing, the first fabric which was not post-heated had a score of 2, whereas the second fabric which was post-heated had a score of 4. Qualitatively, the intensity and depth of the color improved with the post-heating procedure.

If fabric 5 is to undergo transfer printing, the combination of heating the fabric immediately before and after the simultaneous embossing and printing step is particularly advantageous. Thermoplastic fabrics which are heated before the simultaneous embossing and printing receive an adequate amount of dye, but if the fabric is not heated after the embossing and printing step the dye does not penetrate the fabric and tends to rub off. Similarly, the dyes in thermoplastic fabrics which are heated after the embossing and printing step penetrate and remain steadfast, but if the fabric is not heated before the simultaneous embossing and printing, the penetration and steadfastness becomes relatively less significant since not enough dye is transferred in the first place. Therefore, the combination of the steps produces particulary high quality thermoplastic fabric products from simultaneous embossing and printing.

Idler rolls 38 and 39 convey fabric 5 around cooling can 50. Cooling can 50 is a hollow cylinder with a continuous flow of cool water running in a direction perpendicular to the movement of fabric 5. Cooling can 50 is a closed container so that fabric 5 does not get wet. The temperature of fabric 5 is reduced after contacting cooling can 50, so that fabric 5 will be ready for any further processing.

Although heaters 20–23 are described as steam, electric, infrared and infrared respectively, these designations are not meant in any limiting sense as is expected that other types of heaters may be substituted for each. Additionally, although heaters 20 and 21 are described in the singular and heaters 22 and 23 as a plurality, it is expected that one or more heaters may be used at each location, depending on the designer's preference or physical parameters in which the particular apparatus is to be located.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A method for embossing and printing on a fabric having a base and a pile formed essentially of thermoplastic fibers and capable of being embossed by a heated embossing roll and printed by transfer printing means using a sublimatable dyestuff, comprising the steps of:

heating a fabric including a base and a pile of thermoplastic fibers so that the thermoplastic fibers are at least partially plasticized to permit thermal deformation;

brushing the fabric to erect the fiber ends not attached to the fabric base;

simultaneously passing the brushed fabric and a thermal transfer sheet supporting at least one sublimatable dyestuff between two rolls under pressure with respect to each other, the thermal transfer sheet being on the pile side of the fabric with the at least one sublimatable dyestuff facing the pile; the roll on the pile side of the fabric being the embossing roll and heated, the embossing roll having a surface which is engraved, the thermal transfer sheet and fabric being passed between the rolls at a temperature and pressure sufficient to both emboss the fabric by thermal deformation of at least the pile of the fabric and transfer the sublimatable dyestuff to the fabric by the action of the heated non-engraved portions of the surface of the embossing roll, the sublimatable dyestuff not being transferred to the non-embossed portions of the fabric.

2. The method of claim 1, further comprising the step of heating the pile fibers after brushing the fabric and before simultaneously passing the fabric and the transfer sheet between the two rolls such that the pile fibers are nearer the temperature sufficient to transfer the at least one sublimatable dyestuff before being passed between the two rolls.

3. The method of claim 2, wherein the pile fibers are heated after brushing the fabric to a temperature between about 180° to about 195° C.

4. The method of claim 3 further comprising the step of heating the pile fibers after simultaneously passing the fabric and transfer sheet between the two rolls to improve the penetration and set of the dye into pile.

5. The method of claim 1, further comprising cooling the fabric after passing the fabric between the two rolls.

6. The method of claim 1, wherein the pile fibers have denier between about 0.8 and 3 and the pile has a height between about 0.8 and 2.3 mm.

7. The method of claim 6, wherein the fabric passes through the rolls at a speed of between about 1.5 and 4.5 meters per minute.

8. The method of claim 1, wherein the fabric is a woven fabric.

9. The method of claim 1, wherein the fabric is a knit fabric.

10. The method of claim 1, wherein the fabric is a flock fabric and the pile fibers are flock fibers which are attached by an adhesive to the base, and the adhesive is also partially plasticized in the heating step.

11. The method of claim 1, wherein the base is also thermoplastic.

12. A fabric embossed and printed by the method of claim 1.

13. A method for embossing and printing on a fabric including a base and a pile formed essentially of thermoplastic fibers and capable of being embossed by a heated embossing roll and printed by transfer printing using a sublimatable dyestuff, comprising the steps of:

pre-heating the pile fibers in the fabric to a temperature below but close to the temperature required to release a sublimatable dyestuff from a thermal transfer sheet;

immediately following said pre-heating step, simultaneously passing the fabric and a thermal transfer sheet supporting at least one sublimatable dyestuff between two rolls under pressure with respect to each other, the thermal transfer sheet being on the pile side of the fabric with the sublimatable dyestuff facing the pile, the roll on the pile side of the fabric being the embossing roll and heated, the embossing roll having a surface which is engraved, the thermal transfer sheet and fabric being passed between the rolls at a temperature and pressure sufficient to both emboss the fabric by thermal deformation of at least the pile of the fabric and transfer the sublimatable dyestuff to the fabric by the action of the heated non-engraved portions of the surface of the embossing roll, the sublimatable dyestuff not being transferred to the non-embossed portions of the fabric; and post-heating the pile fibers in the fabric after simultaneously passing the fabric and thermal transfer sheet between the two rolls, to a level which improves the penetration and set of the sublimatable dyestuff into the fabric.

14. The method of claim 13, wherein the pile fibers are pre-heated to a temperature between about 180° and about 195° C.

15. The method of claim 14, wherein the pile fibers are pre-heated to about 190° C.

16. The method of claim 13, wherein the pile fibers are post-heated to a temperature between about 180° and about 195° C.

17. The method of claim 14, wherein the pile fibers are post-heated to about 190° C.

18. The method of claim 13, further comprising cooling the fabric after the post-heating step.

19. The method of claim 13, wherein the pile fibers are made of nylon.

20. The method of claim 13, wherein the pile fibers are made of polyester.

21. The method of claim 13, wherein the pile fibers are made of acrylic.

22. The method of claim 13, wherein the fabric passes through the rolls at a speed of between about 1.5 and 4.5 meters per minute.

23. The method of claim 22, wherein the pressure between the two rolls is between about 70 and 110 kg/cm.

24. The method of claim 23, wherein the fabric passes between the two rolls at a temperature of between about 200° and 220° C.

25. A fabric embossed and printed by the method of claim 16.

26. The method of claim 13, further comprising the steps, before the step of pre-heating the pile fibers, of:

heating the fabric so that the pile fibers are at least partially plasticized; and brushing the fabric to erect the fibers.

27. The method of claim 13, wherein the pile fibers are a plurality of thermoplastic flock fibers attached by an adhesive to the base.

28. The method of claim 25, further comprising the steps, before the step of pre-heating the fibers, of:

heating the fabric so that the adhesive and flock fibers are at least partially plasticized; and brushing the fabric to erect the flock fibers.

29. The method of claim 26, wherein the pile fibers have a denier between about 0.8 and 3 and the pile has a height between about 0.8 and 2.3 mm.

30. The method of claim 26, wherein the embossing roll on the side of the pile is selected to have engraving on the surface thereof defining a desired pattern of a depth sufficient to leave the non-embossed part of the pile aligned with the engraved pattern essentially erect after embossing by the part of the surface of the embossing roll which is not engraved.

31. The method of claim 30, wherein said engraving depth is selected to reach a depth greater than the height of the pile.

32. The method of claim 26, further comprising cooling the fabric after the final heating step.

33. A fabric embossed and decorated by the method of claim 26.

34. A method for embossing and decorating a fabric having a base and a pile formed essentially of thermoplastic fibers and capable of being embossed by a heated embossing roll comprising the steps of:

heating a fabric including a base and a pile of thermoplastic fibers so that the thermoplastic fibers are at least partially plasticized to permit thermal deformation;

brushing the fabric to erect the fiber ends not attached to the fabric base;

simultaneously passing the fabric and a carrier sheet which releasably supports a metallic and/or other decorative material between two rolls under pressure with respect to each other, said carrier sheet being on the pile side of the fabric with the decorative material facing the fabric, said decorative material being coated on the side thereof facing the pile with an adhesive selected to be capable of adhering the decorative material to the fabric only when at least a predetermined level of heat is applied to the adhesive, the roll on the pile side of the fabric being the embossing roll and heated, the embossing roll having a surface which is engraved, the carrier sheet and fabric being passed between the rolls at a temperature and pressure sufficient to both emboss the fabric by thermal deformation of at least the pile of the fabric and attach parts of the decorative material to the fabric by the action of the heated non-engraved portions of the surface of the embossing roll, those parts of the decorative material aligned with the non-engraved parts of the surface of said embossing roll being severed from the remaining parts of the decorative material by the embossing roll, the carrier sheet and fabric being passed between the rolls at a temperature sufficient to permit the adhesive on the decorative material to adhere the separated parts of the decorative material to the embossed portions of the fabric but not permitting the remaining portions of the decorative material to be adhered to the non-embossed portions of the fabric.

35. The method of claim 34, further comprising the step of heating the pile fibers after brushing the fabric and before simultaneously passing the fabric and the transfer sheet between the two rolls such that the pile fibers are nearer the temperature sufficient to render the adhesive capable of adhering the decorative material to the fabric before being passed between the two rolls.

36. The method of claim 35, wherein the pile fibers are heated after brushing the fabric to a temperature between about 180° to about 195° C.

37. The method of claim 34, wherein the decorative material is a sheet of foil.

38. The method of claim 34 further comprising cooling the fabric after passing the fabric between the two rolls.

39. The method of claim 34, wherein the pile fibers have a denier between about 0.8 and 3 and the pile has a height between about 0.8 and 2.3 mm.

40. The method of claim 39, wherein the fabric passes through the rolls at a speed of between about 1.5 and 4.5 meters per minute.

41. The method of claim 40, wherein the pressure between the two rolls is between about 70 and 110 kg/cm.

42. The method of claim 41, wherein the fabric passes between the two rolls at a temperature of between about 200 ° and 220° C.

43. The method of claim 34, wherein the fabric is a woven fabric.

44. The method of claim 34, wherein the fabric is a knit fabric.

45. The method of claim 34, wherein the fabric is a flock fabric and the pile fibers are flock fibers which are attached by an adhesive to the base, and the adhesive is also partially plasticized in the heating step.

46. The method of claim 34, wherein the base is also thermoplastic.

47. A fabric embossed and decorated by the method of claim 37.

48. The method of claim 34, wherein the pile fibers are made of nylon.

49. The method of claim 34, wherein the pile fibers are made of polyester.

50. The method of claim 34, wherein the pile fibers are made of acrylic.

51. The method of claim 37, wherein the embossing roll on the side of the pile is selected to have engraving on the surface thereof defining a desired pattern of a depth sufficient to leave the non-embossed part of the pile in alignment with the engraved pattern essentially erect after embossing by the portion of the surface of the embossing roll which is not engraved.

52. The method of claim 51, wherein said engraving depth is selected to reach a depth greater than the height of the pile.

* * * * *